US009727029B2

(12) United States Patent
Fujisawa

(10) Patent No.: US 9,727,029 B2
(45) **Date of Patent: *Aug. 8, 2017**

(54) ELECTRONIC TIMEPIECE HAVING AN ANTENNA BODY WITH DIELECTRIC

(71) Applicant: Seiko Epson Corporation, Tokyo (JP)

(72) Inventor: Teruhiko Fujisawa, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/591,238

(22) Filed: Jan. 7, 2015

(65) Prior Publication Data

US 2015/0220066 A1 Aug. 6, 2015

(30) Foreign Application Priority Data

Jan. 31, 2014 (JP) ..... 2014-017369

(51) Int. Cl.

| | |
|---|---|
| ***G04G 17/04*** | (2006.01) |
| ***G04R 60/00*** | (2013.01) |
| ***G04R 60/08*** | (2013.01) |
| ***G04R 60/06*** | (2013.01) |
| ***G04R 60/10*** | (2013.01) |
| ***G04R 60/12*** | (2013.01) |

(52) U.S. Cl.

CPC ..... *G04G 17/04* (2013.01); *G04R 60/00* (2013.01); *G04R 60/06* (2013.01); *G04R 60/08* (2013.01); *G04R 60/10* (2013.01); *G04R 60/12* (2013.01)

(58) Field of Classification Search

CPC ..... G04G 17/04; G04R 20/02; G04R 20/04; G04R 20/06; G04R 60/06; G04R 60/08; G04R 60/10; G04R 60/12; G04R 60/00; G04C 3/008

USPC ..... 368/47, 294, 295

See application file for complete search history.

(56) References Cited

U.S. PATENT DOCUMENTS 5,159,347 A * 10/1992 Osterwalder ..... H01Q 7/00 324/219
5,465,098 A * 11/1995 Fujisawa ..... H01Q 13/10 343/718
5,646,634 A * 7/1997 Bokhari ..... H01Q 9/0407 368/10
5,870,057 A * 2/1999 Evans ..... H01Q 1/38 343/700 MS
5,952,972 A * 9/1999 Ittipiboon ..... H01Q 9/0485 343/700 MS (Continued)

FOREIGN PATENT DOCUMENTS

JP 2003-050983 2/2003
JP 2005-102183 A 4/2005

(Continued)

*Primary Examiner* — Amy Cohen Johnson
*Assistant Examiner* — Daniel Wicklund
(74) *Attorney, Agent, or Firm* — Harness, Dickey & Pierce, P.L.C.

(57) ABSTRACT

An electronic timepiece includes a case formed of a metal case barrel and a metal bezel, and the case accommodates an antenna body made of a resin mixed with a dielectric material and having an annular shape. A dielectric auxiliary member made of a dielectric having a dielectric constant greater than that of the antenna body and having an annular shape is disposed between the antenna body and the bezel.

15 Claims, 8 Drawing Sheets

(56) References Cited

U.S. PATENT DOCUMENTS 7,119,745 B2 * 10/2006 Gaucher ..... H01Q 9/26 343/700 MS
7,126,548 B2 * 10/2006 Yano ..... G04R 60/12 343/702
7,286,098 B2 10/2007 Ogino et al.
7,333,063 B2 * 2/2008 Yano ..... G04G 21/04 368/10
8,456,368 B2 * 6/2013 Murata ..... H01Q 1/273 343/718
8,456,959 B2 6/2013 Fujisawa
8,487,818 B2 * 7/2013 Kim ..... H01Q 1/52 343/700 MS
2005/0018543 A1 * 1/2005 Fujisawa ..... G04G 5/002 368/47
2009/0316536 A1 * 12/2009 Kachi ..... G04G 17/08 368/278
2011/0013491 A1 * 1/2011 Fujisawa ..... G04R 60/06 368/10
2012/0105288 A1 * 5/2012 Abe ..... G04C 10/02 343/702
2012/0120772 A1 * 5/2012 Fujisawa ..... G04C 10/02 368/64
2012/0170423 A1 * 7/2012 Fujisawa ..... G04C 10/02 368/10
2012/0213039 A1 * 8/2012 Aizawa ..... G04R 20/04 368/47
2013/0051181 A1 2/2013 Fujisawa
2013/0300618 A1 * 11/2013 Yarga ..... H01Q 1/243 343/720
2014/0085153 A1 3/2014 Nagahama
2014/0086026 A1 * 3/2014 Mitani ..... G04R 60/12 368/278
2014/0232603 A1 * 8/2014 Fujisawa ..... G04R 60/12 343/702
2014/0240181 A1 8/2014 Mamuro et al.

FOREIGN PATENT DOCUMENTS

JP 3982918 B2 9/2007
JP 2009-168656 7/2009
JP 2011-146779 7/2011
JP 2012-075090 A 4/2012
JP 2012-235224 A 11/2012
JP 2013-064723 4/2013
JP 2013-183437 9/2013

* cited by examiner

ELECTRONIC TIMEPIECE HAVING AN ANTENNA BODY WITH DIELECTRIC

BACKGROUND

1. Technical Field

The present invention relates to an electronic timepiece with an antenna body.

2. Related Art

As an electronic timepiece that receives electrical radiation, for example, from a GPS satellite, an electronic timepiece with a built-in antenna body has been proposed. In particular, to improve sensitivity at which the antenna body receives electrical radiation, the antenna body is formed in a ring shape (JP-A-2013-64723, for example).

The antenna body described in JP-A-2013-64723 is so configured that an antenna base made of a resin mixed with a dielectric material is formed in a ring shape and an antenna electrode pattern is formed on the antenna base.

An electronic timepiece of the type described above uses a wavelength shortening effect achieved by a dielectric to reduce the size of the antenna body. To further enhance the wavelength shortening effect, it is conceivable to use a ceramic material or any other dielectric having a large dielectric constant to form the antenna body.

However, a ceramic material or any other dielectric is difficult to process and therefore has a problem of low shape flexibility. In an electronic timepiece that accommodates a large number of parts in a narrow space, in particular, it is necessary to form the antenna body in a complicated shape in some cases, but the antenna body having a complicated shape cannot be made of a ceramic material or any other dielectric.

SUMMARY

An advantage of some aspects of the invention is to provide an electronic timepiece capable of enhancing a wavelength shortening effect achieved by an antenna body made of a dielectric.

An electronic timepiece according to an aspect of the invention includes a case, a time display section, an antenna body that is disposed around an outer circumferential portion of the time display section but accommodated in the case and includes a dielectric-containing base with an antenna element provided thereon, and a dielectric auxiliary member that is disposed along the antenna body and contains a dielectric, and the dielectric auxiliary member has a dielectric constant greater than the dielectric constant of the base.

In the aspect of the invention, since the dielectric auxiliary member having a dielectric constant greater than the dielectric constant of the base of the antenna body is disposed along the antenna body, a wavelength shortening effect achieved by the antenna body containing a dielectric can be enhanced, whereby the size of the antenna body can be reduced. An antenna body basically needs to have a length equal to one-half the wavelength of electrical radiation to be transmitted and received. Even when a dielectric is used to achieve wavelength shortening, transmission and reception of 1.5-GHz electrical radiation used in a GPS and 2.4-GHz electrical radiation used in Bluetooth (registered trademark) requires an antenna length of several centimeters. In the invention, since the antenna body is disposed around the time display section, the space in the timepiece is efficiently used. In the invention, "containing a dielectric" includes a case where a component is made of a resin or any other material mixed with a dielectric material, and a case where a component is made only of a dielectric material, such as a ceramic material. The same holds true for the rest of the present specification.

In the electronic timepiece according to the aspect of the invention described above, the dielectric contained in the dielectric auxiliary member may have hardness higher than the hardness of the base of the antenna body. In this case, although the dielectric auxiliary member itself that enhances the wavelength shortening effect is difficult to process, the hardness of the base of the antenna body is lower than the hardness of the dielectric auxiliary member, and the antenna body can therefore be readily processed, whereby the antenna body can be processed into a complicated shape. The hardness described above is a value expressed, for example, in Vickers hardness.

In the electronic timepiece according to the aspect of the invention described above, the case may have a portion that is made of a metal and covers at least part of the antenna body in a side view of the electronic timepiece or the case may have a member that is made of a metal and located on a portion of the case that covers the part of the antenna body in a side view of the electronic timepiece, and the dielectric auxiliary member may be disposed between the antenna body and the portion made of a metal or the member made of a metal. When a metal is present in a portion that covers the antenna body in a side view of the electronic timepiece, it is conceivable that the metal undesirably blocks electrical radiation carrying a signal to be received, resulting in a decrease in reception sensitivity of the antenna body. According to the aspect of the invention, since the dielectric auxiliary member is disposed between the portion made of a metal or the member made of a metal and the antenna body, a large wavelength shortening effect is achieved, whereby the size of the antenna body can be reduced, and the portion made of a metal or the member made of a metal can be appropriately set apart from the antenna body. The reception sensitivity of the antenna body therefore does not lower. Further, the portion of the case that covers the antenna body can be made of a metal, or a member made of a metal can be provided in the portion of the case that covers the antenna body, whereby design flexibility can be increased.

In the electronic timepiece according to the aspect of the invention described above, the member made of a metal and located in a portion of the case that covers at least the antenna body may be attached to a member made of a resin. In this case, since the dielectric auxiliary member is disposed between the member made of a metal and the antenna body, a large wavelength shortening effect is achieved, whereby the size of the antenna body can be reduced, and the member made of a metal can be appropriately set apart from the antenna body. The reception sensitivity of the antenna body therefore does not lower. Further, a member made of a metal can be provided on the portion of the case that covers the antenna body, whereby design flexibility can be increased.

In the electronic timepiece according to the aspect of the invention described above, each of the antenna body and the dielectric auxiliary member may be formed in a ring shape. In this case, since the antenna body has a ring shape, the antenna body can be disposed around a driver of the electronic timepiece, whereby the space in the case can be effectively used. Further, since the dielectric auxiliary member also has a ring shape, the space in the case can be effectively used and a large wavelength shortening effect can be achieved at the same time. In the invention, the term "ring shape" means a ring that is seamless throughout its length with no discontinuity and hence includes not only an annular shape but also a seamless rectangular shape. The same holds true for the rest of the specification.

In the electronic timepiece according to the aspect of the invention described above, the base of the antenna body may have a recess formed therein and the recess may prevent the base from interfering with another member, or the base of the antenna body may have a fixing portion formed therein and the fixing portion may fix the antenna body to the base. In this case, forming the recess or the fixing portion in the antenna body allows a narrow space to be effectively used to accommodate a large number of parts and components in the case. To form the recess or the fixing portion in the antenna body, the hardness of the antenna body needs to be low, and it is therefore difficult to form the antenna body, for example, by using a ceramic material, which has a large dielectric constant. In the aspect of the invention, the dielectric auxiliary member having hardness higher than that of the antenna body is provided around the antenna body. Therefore, for example, forming the dielectric auxiliary member by using a ceramic material having a large dielectric constant allows the recess or the fixing portion to be formed in the antenna body and a large wavelength shortening effect to be achieved at the same time.

The electronic timepiece according to the aspect of the invention described above may further include a cover member that covers one opening of the case, and the dielectric auxiliary member may have an L-like cross-sectional shape with part of the dielectric auxiliary member disposed between the antenna body and the case and part of the dielectric auxiliary member disposed between the antenna body and the cover member.

In the electronic timepiece according to the aspect of the invention described above, the dielectric auxiliary member may be disposed between the time display section and the antenna body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
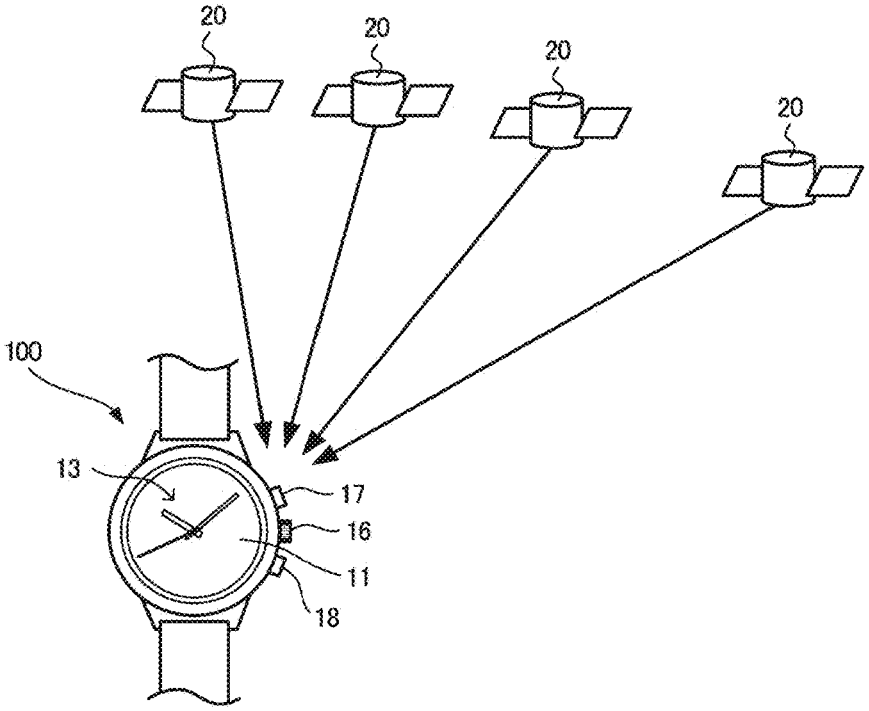
FIG. 1 is an overall view of a GPS system including an electronic timepiece with a built-in antenna according to a first embodiment of the invention.

Preferable embodiments according to the invention will be described below with reference to the accompanying drawings. In the drawings, the dimension and scale of each portion differs from an actual dimension and scale as appropriate. Further, since the embodiments that will be described below are preferable specific examples of the invention, a variety of technically preferable restrictions are imposed thereon, but the scope of the invention is not limited to the embodiments unless the following explanation includes a particular description of limitation of the invention.

First Embodiment

A. Mechanical Configuration of Electronic Timepiece with Built-in Antenna

FIG. 1 is a schematic view showing an overall GPS system including an electronic timepiece 100 with a built-in antenna (hereinafter referred to as "electronic timepiece 100") according to a first embodiment of the invention. The electronic timepiece 100 is a wristwatch that receives electrical radiation (wireless signal) from at least one of a plurality of GPS satellites 20 to correct internal time, and the electronic timepiece 100 displays time on the side (hereinafter referred to as "front side") of the timepiece that faces away from the side in contact with an arm (hereinafter referred to as "rear side"). In the following description, the rear side is called a "lower side," and the front side is called an "upper side."

Each of the GPS satellites 20 is a position information satellite that goes along a predetermined orbit around the earth up in the sky and transmits 1.57542-GHz electrical radiation (L1 wave) with a navigation message superimposed thereon to the ground. In the following description, the 1.57542-GHz electrical radiation with a navigation message superimposed thereon is referred to as a "satellite signal." The satellite signal is formed of a right-handed circularly polarized wave.

The following description will be made with reference to a case where the GPS system is an example of a satellite positioning system, but the GPS system is only one example of a satellite positioning system. In the embodiment of the invention, the following satellite-based systems can be used: a global navigation satellite system (GNSS), such as Galileo (EU), GLONASS (Russia), and BeiDou (China); and a satellite positioning system including a positional information satellite that transmits a satellite signal containing time information, such as SBAS or any other stationary satellite and a quasi-zenith satellite. That is, the electronic timepiece 100 may be a wristwatch that receives electrical radiation (wireless signal) from a position information satellite including a satellite other than the GPS satellites 20 to correct internal time.

At present, approximately 31 GPS satellites (FIG. 1 shows only four of the approximately 31 satellites) are present. To allow the electronic timepiece 100 to distinguish which of the GPS satellites 20 has transmitted a satellite signal, each of the GPS satellites 20 superimposes a specific pattern, which is called a C/A code (coarse/acquisition code) formed of 1023 chips (and having a period of 1 ms), on the satellite signal. The C/A code, in which each of the chips is either +1 or −1, appears to be a random pattern. Examining correlation between an actually received satellite signal and the pattern formed of each known C/A code therefore allows detection of the C/A code superimposed on the satellite signal.

Each of the GPS satellites 20 has an atomic clock incorporated therein, and the satellite signal contains very accurate time information (hereinafter referred to as "GPS time information") having been measured by using the atomic clock. Further, a ground control segment measures a slight time error produced by the atomic clock incorporated in each of the GPS satellites 20, and the satellite signal also contains a time correction parameter for correcting the time error. The electronic timepiece 100 receives the satellite signal transmitted from one of the GPS satellites 20 and uses the GPS time information and the time correction parameter contained in the satellite signal to correct the internal time to achieve correct time.

The satellite signal further contains orbit information representing the on-orbit position of the GPS satellite 20. The electronic timepiece 100 can perform positioning calculation by using the GPS time information and the orbit information. The positioning calculation is performed based on the assumption that the internal time of the electronic timepiece 100 contains an error to some extent. That is, not only three parameters x, y, and z for identifying the three-dimensional position of the electronic timepiece 100 but also the time error are unknown. The electronic timepiece 100 therefore typically receives satellite signals transmitted from at least four GPS satellites and uses the GPS time information and the orbit information contained in the received satellite signals for the positioning calculation.

Figure 2:
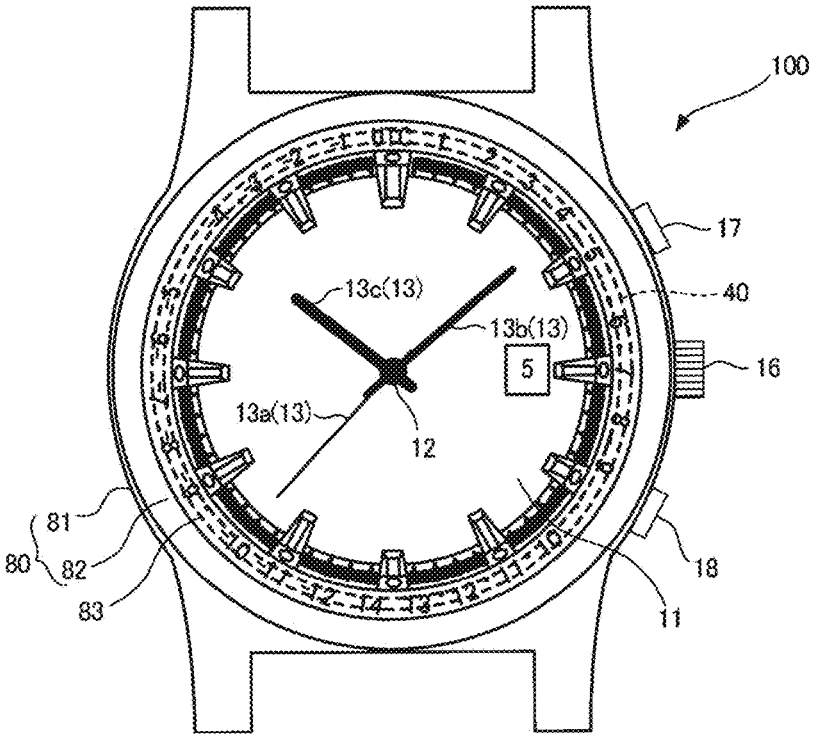
FIG. 2 is a plan view of the electronic timepiece.

FIG. 2 is a plan view of the electronic timepiece 100. The electronic timepiece 100 includes an exterior case 80, as shown in FIG. 2. The exterior case 80 has a cylindrical case barrel 81, which is made of a metal or any other conductive material, and a bezel 82, which is also made of a metal or any other conductive material, and the bezel 82 is fit into the case barrel 81. The bezel 82 and the case barrel 81 are not necessarily separate components and may instead be integrated with each other. In this case, cost reduction is achieved.

Inside the bezel 82 is disposed a dial ring 83 having a ring shape and made of a resin or any other nonconductive material, and inside the dial ring 83 is disposed a disk-shaped dial 11. On the dial ring 83 are provided index markings, each of which is a bar-shaped index member representing, for example, time (hour), at 30-degree intervals, and on the dial 11 are provided no index markings of this type. Information shown on the dial ring 83 and information shown on the dial 11 only need to differ from each other and are not limited to the information shown in FIG. 2.

On the dial 11 are disposed indication hands 13 (13*a* to 13*c*), which turn around an indication hand shaft 12 and indicate current time. The dial 11 is hereinafter called a time display section in some cases.

The exterior case 80 has two openings, a front-side opening and a rear-side opening, which will be described later in detail. The front-side opening of the exterior case 80 is blocked with a cover glass plate 84 (cover member) with the bezel 82 therebetween, and the dial 11 and the indication hands 13 (13*a* to 13*c*) are visible through the cover glass plate 84.

The electronic timepiece 100 includes a crown 16 and operation buttons 17 and 18, as shown in FIGS. 1 and 2. The operation mode of the electronic timepiece 100 can be switched through manual operation of the crown 16 and the operation buttons 17 and 18 between a mode in which the electronic timepiece 100 receives a satellite signal from at least one of the GPS satellites 20 for correction of internal time information (time information acquisition mode) and mode in which the electronic timepiece 100 receives satellite signals from a plurality of the GPS satellites 20 for the positioning calculation, followed by correction of time difference between the internal time information and correct time (position information acquisition mode). Further, the electronic timepiece 100 can regularly (automatically) switch the operation mode thereof between the time information acquisition mode and the position information acquisition mode.

Figure 3:
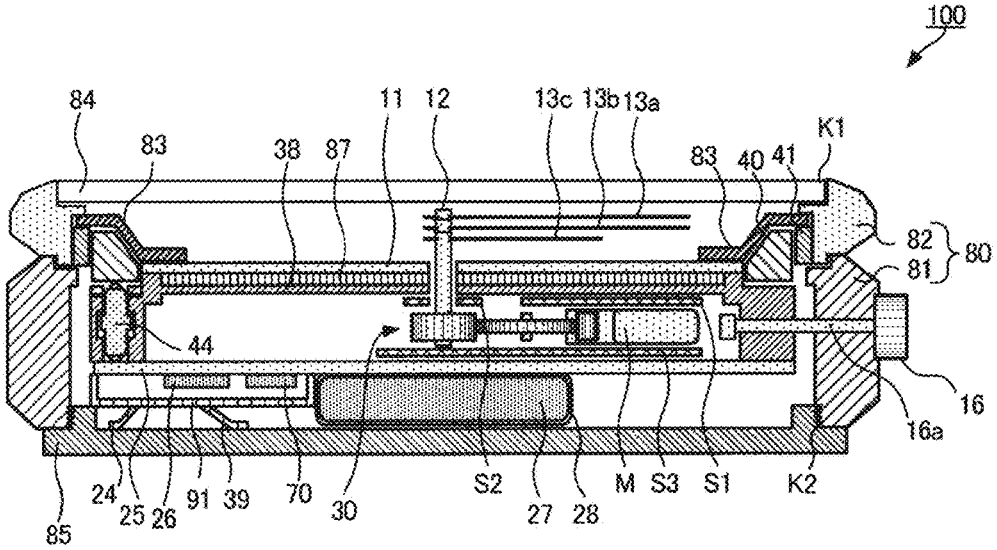
FIG. 3 is a partial cross-sectional view of the electronic timepiece.
Figure 4:
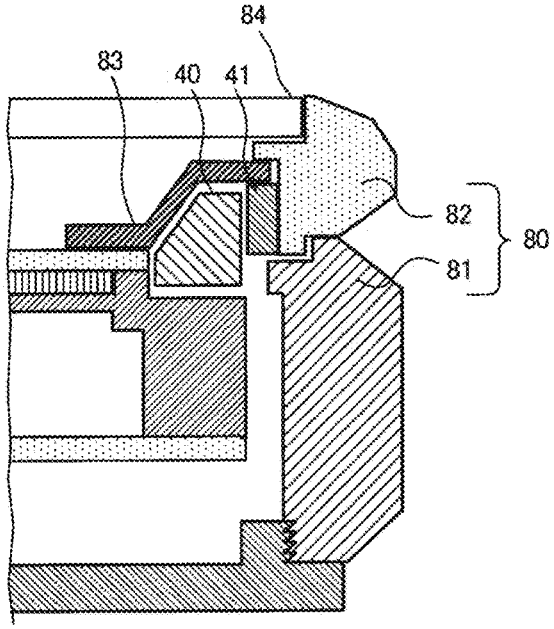
FIG. 4 is a partial cross-sectional view of an antenna body and components therearound in the electronic timepiece.
Figure 5:
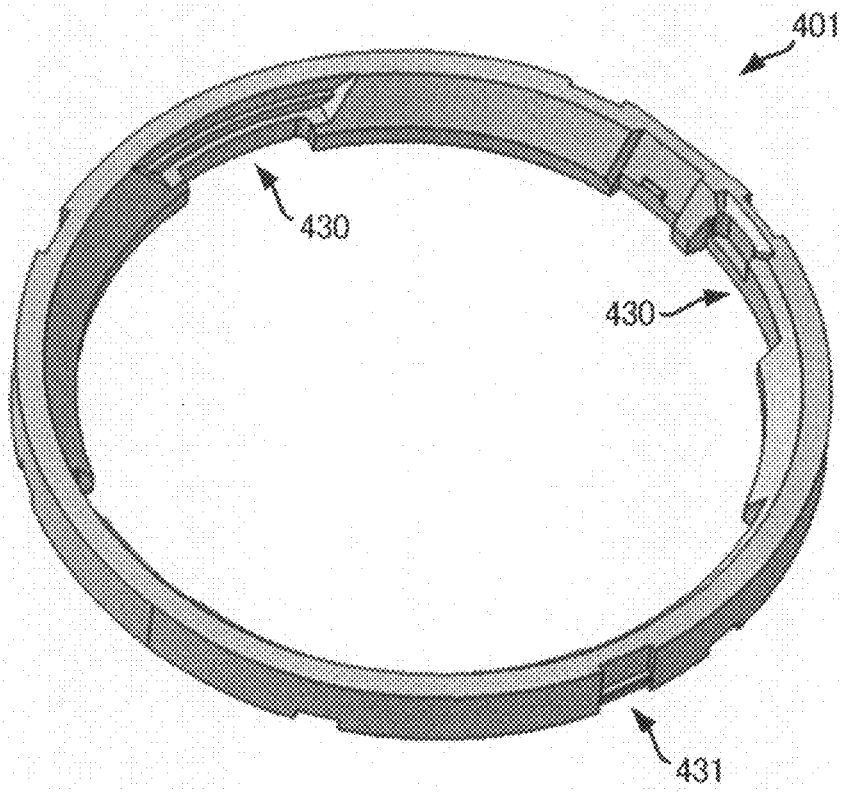
FIG. 5 is a perspective view showing the shape of the antenna body in the electronic timepiece.
Figure 6:
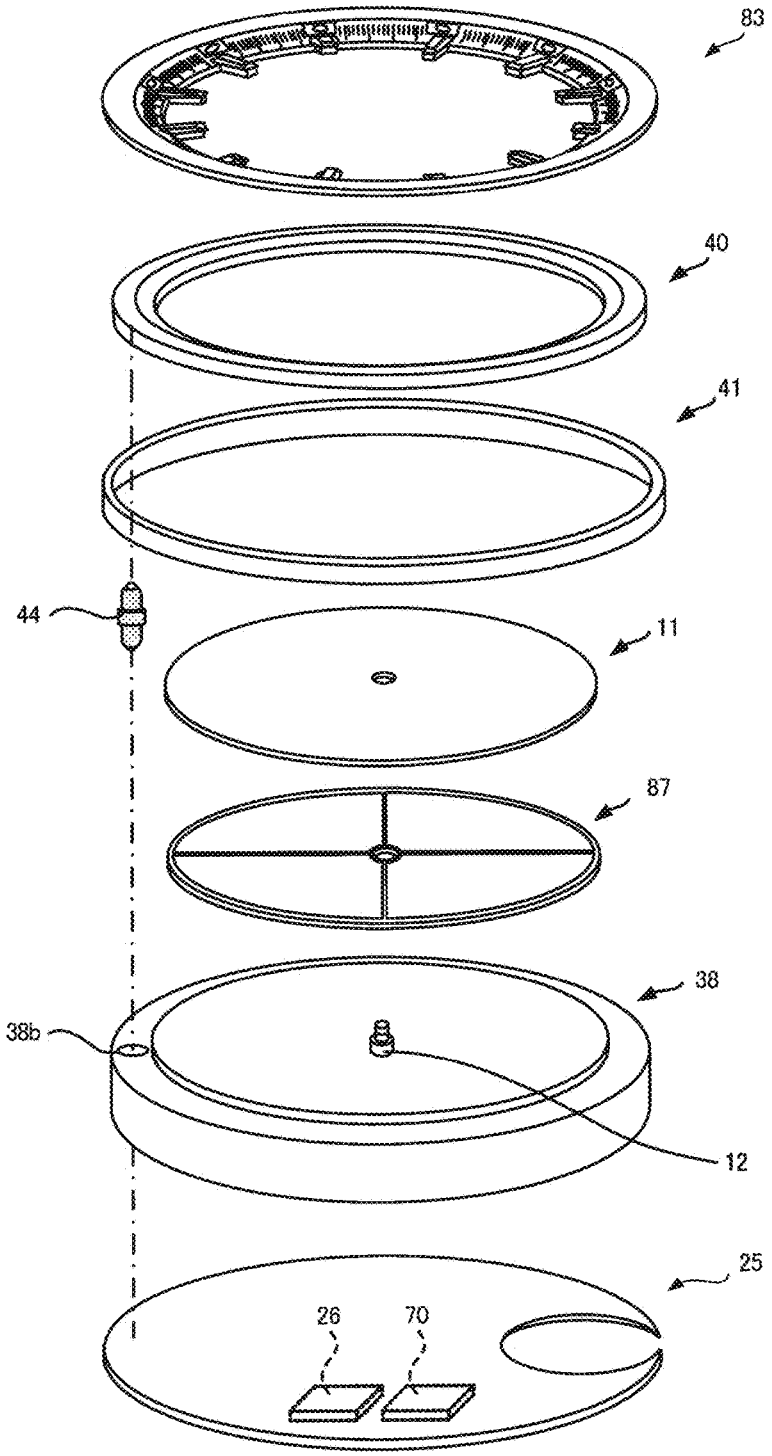
FIG. 6 is an exploded perspective view of part of the electronic timepiece.

FIG. 3 is a partial cross-sectional view showing the internal structure of the electronic timepiece 100, and FIG. 4 is an enlarged view of an antenna body, a dielectric auxiliary member, and components therearound. FIG. 5 is a perspective view showing an actual shape of the antenna body, and FIG. 6 is an exploded perspective view of part of the electronic timepiece 100. As shown in FIG. 3, the exterior case 80 has the cylindrical case barrel 81, which is made of SUS (stainless steel), Ti (titanium), or any other metal, and the bezel 82, which is also made of SUS (stainless steel), Ti (titanium), or any other metal, and the bezel 82 is fit into the case barrel 81. The exterior case 80 has a front-side opening K1 and a rear-side opening K2. The front-side opening K1 of the exterior case 80 is blocked with the disc-shaped cover glass plate 84, and the rear-side opening K2 of the exterior case 80 is blocked with a case back 85 made of SUS (stainless steel), Ti (titanium), or any other metal. The case back 85 and the case barrel 81 are fixed to each other, for example, via screw grooves.

The ring-shaped dial ring 83 made of a resin or any other nonconductive material is provided below (on rear surface side of) the cover glass plate 84 and along the inner circumference of the bezel 82. Further, a main plate 38 made of a resin or any other nonconductive material is provided below the dial ring 83 and inside the inner circumference of the case barrel 81. An antenna body 40 is covered by the dial ring made of ABS or any other resin that does not prevent reception of GPS electrical radiation, and markings representing time are printed on the front surface of the dial ring.

The main plate 38, the dial ring 83, and the inner circumference of the exterior case 80 form a donut-shaped accommodation space. The accommodation space accommodates the antenna body 40 having an annular shape and made of a resin mixed with a dielectric. The antenna body 40 is therefore accommodated inside the inner circumference of the bezel 82, and the dial ring 83 covers an upper portion of the antenna body 40. An antenna body basically needs to have an antenna length equal to one-half the wavelength of electrical radiation to be transmitted and received. Even when a dielectric is used to achieve wavelength shortening, transmission and reception of 1.5-GHz electrical radiation used in a GPS and 2.4-GHz electrical radiation used in Bluetooth (registered trademark) requires an antenna length of several centimeters. In the embodiment of the invention, since the antenna body is disposed around the dial 11, which is the time display section, the space in the timepiece is efficiently used. An antenna electrode pattern (element) (not shown) is formed on the front surface of the antenna body 40, for example, in a plating process, in the form of a flexible printed circuit (FPC), or in a silver paste printing process. The antenna electrode pattern includes a loop-shaped element having a C-like loop shape and an arcuate excitation element having a diameter substantially equal to the diameter of the loop-shaped element and disposed in such a way that the excitation element faces the loop-shaped element and is substantially concentric therewith. The loop-shaped element and the excitation element are disposed in parallel to each other with a predetermined distance therebetween and electromagnetically coupled to each other. One end of the excitation element is bent downward and caused to come into contact with a feed pin 44, which is so disposed that it stands upright. The feed pin 44 is electrically connected not only to the case back 85 via a substrate 25, a shield 91, and a conduction spring 24 but also to the case barrel 81 because the case back 85 is fixed to the case barrel 81. As a result, a predetermined potential is supplied to the antenna electrode pattern on the antenna body 40.

An annular dielectric auxiliary member 41, which is made, for example, of zirconia having a dielectric constant greater than the dielectric constant of the antenna body 40, is disposed between the antenna body 40 and the bezel 82. In the present embodiment, the dielectric constant of the antenna body 40 ranges from about 5 to 20 as will be described later, and the dielectric auxiliary member 41, which is made of zirconia ($ZrO_2$) having a dielectric constant ranging from 30 to 40 and disposed in the vicinity of the antenna body 40, allows a large wavelength shortening effect to act on the antenna body 40, antenna performance of which can therefore be improved. Details will be described later.

As shown in FIG. 3, inside the inner circumference of the antenna body 40 are provided the dial 11, which is light transmissive, the indication hand shaft 12, which passes through the dial 11 and the main plate 38, and the plurality of indication hands 13 (second hand 13*a*, minute hand 13*b*, and hour hand 13*c*), which go around the indication hand shaft 12 and indicate current time.

The indication hand shaft 12 extends frontward and rearward along the central axis of the exterior case 80. The dial 11 is a circular plate and made of a light transmissive, nonconductive material, such as a resin. The dial 11 is disposed between the cover glass plate 84 and the main plate 38, as shown in FIG. 3. A hole through which the indication hand shaft 12 passes is formed through a central portion of the dial 11. The indication hands 13 are disposed inside the inner circumference of the antenna body 40 and between the cover glass plate 84 and the dial 11.

A drive mechanism (driver) 30, which rotates the indication hand shaft 12 to drive the plurality of indication hands 13, is attached to the lower side (rear surface side) of the main plate 38. The drive mechanism 30 has a stepper motor M and wheel trains, such as gears. The stepper motor M rotates the indication hand shaft 12 via the wheel trains to drive the plurality of indication hands 13. Specifically, the drive mechanism 30 rotates the indication hand shaft 12 in such a way that the hour hand 13*c*, the minute hand 13*b*, and the second hand 13*a* make a turn in 12 hours, 60 minutes, and 60 seconds, respectively, around the indication hand shaft 12.

The electronic timepiece 100 further includes the substrate 25 inside the exterior case 80. The substrate 25 is made of a material containing a resin or any other dielectric and disposed below the drive mechanism 30 (that is, between the drive mechanism 30 and the case back 85).

A circuit block including a GPS receiver (wireless receiver) 26 and a controller 70 is implemented on the lower surface (rear surface) of the substrate 25. The GPS receiver 26 is formed, for example, of a single-chip IC module that includes an analog circuit and a digital circuit. The controller 70 sends a control signal to the GPS receiver 26 to control reception operation of the GPS receiver 26 and controls the operation of the drive mechanism 30.

The feed pin 44 made of a metal or any other conductive material is provided above the substrate 25. The feed pin 44 has a built-in spring, and comes into contact with a feed portion of the antenna body 40, and the feed pin 44 passes through an insertion hole 38*b* (see FIG. 6) that is open through the main plate 38 and comes into contact with the substrate 25. The feed portion of the antenna body 40 is therefore electrically connected to the substrate 25 (wiring provided on the substrate 25 in an exact sense) via the feed pin 44, and the substrate 25 supplies the antenna body 40 with a predetermined potential.

The circuit block including the GPS receiver 26 and the controller 70 is covered with the shield 91 made of a conductive material. The shield 91 is electrically connected to the ground plate 90 via a circuit holding-down member 39, the case back 85, and the case barrel 81. Further, a ground potential in the circuit block is supplied to the shield 91. That is, each of the shield 91, the case back 85, the case barrel 81, and the ground plate 90 has a potential kept equal to the ground potential in the circuit block and hence functions as a ground plane.

Antimagnetic plates S1 and S2 are provided between the drive mechanism 30 and the main plate 38, and an antimagnetic plate S3 is provided between the drive mechanism 30 and the substrate 25. In the following description, the antimagnetic plates S1 and S2 are collectively referred to as a first antimagnetic plate, and the antimagnetic plate S3 is collectively referred to as a second antimagnetic plate in some cases. The antimagnetic plates S1 to S3 are made of a conductive material having high magnetic permeability, such as pure iron.

When an object that produces an intense magnetic field, such as a loud speaker, is present outside the electronic timepiece 100, the stepper motor M may malfunction due to an effect of the magnetic field. Further, among the variety of components that form the electronic timepiece 100, the metals of which the case barrel 81, the case back 85, and other components are made to produce magnetic fields when they are magnetized. Moreover, the circuit block provided on the substrate 25 may also produce a magnetic field.

In the present embodiment, the antimagnetic plates S1 to S3, which are made of a material having high magnetic permeability and cover the stepper motor M, magnetically shield the drive mechanism 30, preventing the stepper motor M from malfunctioning due to the variety of magnetic fields described above.

The electronic timepiece 100 further includes a cylindrically-shaped secondary battery 27, such as a lithium-ion battery, a battery accommodation section 28, which accommodates the secondary battery 27, and a solar panel 87, which photo-electrically generates electric power, inside the exterior case 80.

The solar panel 87 is a circular flat plate in which a plurality of solar cells (photo-electric, power generating devices), each of which converts optical energy into electric energy (electric power), are serially connected to each other. The solar panel 87 is disposed inside the inner circumference of the antenna body 40 and between the main plate 38 and the dial 11. A hole through which the indication hand shaft 12 passes is formed through a central portion of the solar panel 87.

The secondary battery 27 is charged with electric power generated by the solar panel 87. The battery accommodation section 28, which accommodates the secondary battery 27, is disposed below the substrate 25 (that is, between substrate 25 and case back 85).

The crown 16 and the operation buttons 17 and 18 are provided on the exterior of the exterior case 80 (see FIG. 2). Motion of the crown 16 produced when a user of the electronic timepiece 100 operates the crown 16 is transmitted via a hand setting stem 16*a*, which passes through the exterior case 80, to the drive mechanism 30. Further, motion of the operation button 17 (or 18) produced when the user of the electronic timepiece 100 presses the operation button 17 (or 18) is transmitted via a button shaft (not shown) that passes through the exterior case 80 to a switch (not shown). The switch then converts the pressure from the operation button 17 (or 18) into an electric signal and transmits the electric signal to the controller 70.

In the following description, the crown 16, the hand setting stem 16*a*, the operation buttons 17 and 18, and the button shaft are collectively referred to as an operation section in some cases.

B. Circuit Configuration of Electronic Timepiece with Built-in Antenna

Figure 7:
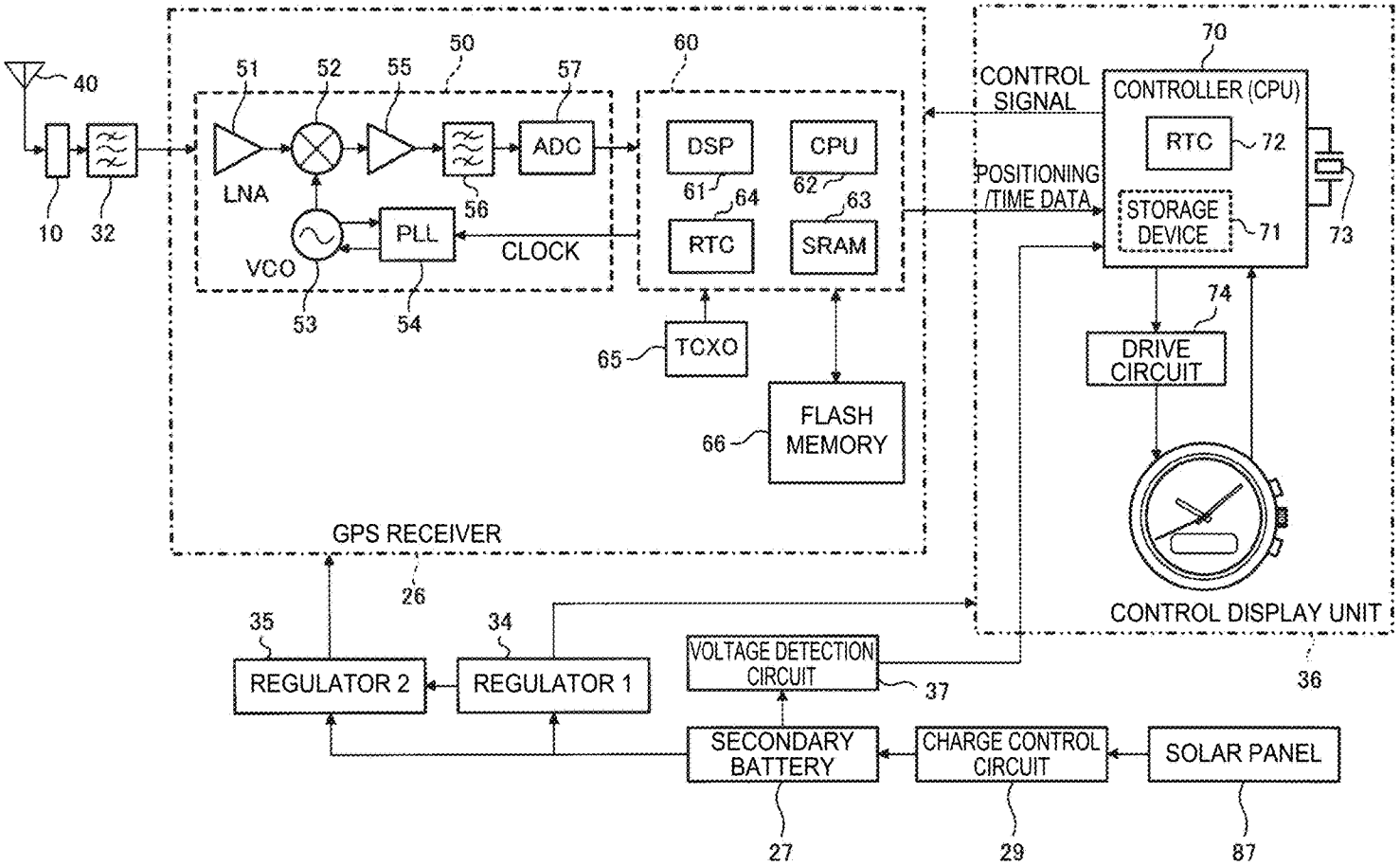
FIG. 7 is a block diagram showing the circuit configuration of the electronic timepiece.

FIG. 7 is a block diagram showing the circuit configuration of the electronic timepiece 100. The electronic timepiece 100 includes the GPS receiver 26 and a control display unit 36, as shown in FIG. 7. The GPS receiver 26 receives a satellite signal, locates the corresponding GPS satellite 20, produces position information, produces time correction information, and carries out other processes. The control display unit 36 holds the internal time information, corrects the internal time information, and carries out other processes.

The solar panel 87 charges the secondary battery 27 via a charge control circuit 29. The electronic timepiece 100 includes regulators 34 and 35, and the secondary battery 27 supplies the control display unit 36 with drive electric power via the regulator 34 and the GPS receiver 26 with drive electric power via the regulator 35. The electronic timepiece 100 further includes a voltage detection circuit 37, which detects the voltage across the secondary batter 27. The regulator 35 may be replaced, for example, with the following two regulators: a regulator 35-1, which supplies an RF section 50 (which will be described later in detail) with drive electric power, and a regulator 35-2, which supplies a baseband section 60 (which will be described later in detail) with drive electric power (neither regulator 35-1 nor 35-2 is shown). The regulator 35-1 may be disposed in the RF section 50.

The electronic timepiece 100 further includes the antenna body 40 and an SAW (surface acoustic wave) filter 32. The antenna body 40 receives satellite signals from a plurality of the GPS satellites 20, as described with reference to FIG. 1. The antenna body 40, however, receives a small amount of unnecessary electrical radiation other than the satellite signals. The SAW filter 32 therefore extracts the satellite signals from the signals received by the antenna body 40. That is, the SAW filter 32 is configured as a bandpass filter that allows a 1.5-GHz-band signal to pass therethrough.

The GPS receiver 26 includes the RF (radio frequency) section 50 and the baseband section 60. As will be described below, the GPS receiver 26 acquires satellite information, such as the orbit information and the GPS time information, which are contained in a navigation message, from the 1.5-GHz-band satellite signal extracted by the SAW filter 32.

The RF section 50 includes an LNA (low noise amplifier) 51, a mixer 52, a VCO (voltage controlled oscillator) 53, a PLL (phase locked loop) circuit 54, an IF amplifier 55, an IF (intermediate frequency) filter 56, and an ADC (A/D converter) 57.

The satellite signal extracted by the SAW filter 32 is amplified by the LNA 51. The satellite signal amplified by the LNA 51 is mixed by the mixer 52 with a clock signal outputted from the VCO 53 into a down-converted signal of an intermediate frequency band. The PLL circuit 54 compares a divided clock signal derived from a clock signal outputted from the VCO 53 with a reference clock signal in terms of phase to synchronize the clock signal outputted from the VCO 53 with the reference clock signal. As a result, the VCO 53 can output a stable clock signal of which the frequency is as precise as the reference clock signal. The intermediate frequency can, for example, be several MHz.

The mixture signal from the mixer 52 is amplified by the IF amplifier 55. At this point, the mixing performed by the mixer 52 produces not only the intermediate-frequency-band signal but also a high-frequency signal of several GHz. The IF amplifier 55 therefore amplifies not only the intermediate-frequency-band signal but also the high-frequency signal of several GHz. The IF filter 56 allows the intermediate-frequency-band signal to pass therethrough but removes the high-frequency signal of several GHz (To be precise, the IF filter 56 attenuates the level of the high-frequency signal to a predetermined level or lower). The intermediate-frequency-band signal having passed through the IF filter 56 is converted by the ADC (A/D converter) 57 into a digital signal.

The baseband section 60 includes a DSP (digital signal processor) 61, a CPU (central processing unit) 62, an SRAM (static random access memory) 63, and an RTC (real time clock) 64. A temperature compensated crystal oscillator (TCXO) 65, a flash memory 66, and other components are connected to the baseband section 60.

The temperature compensated crystal oscillator (TCXO) 65 produces the reference clock signal, which has a substantially fixed frequency irrespective of temperature. The flash memory 66 stores, for example, time difference information. The time difference information is information in which time difference data (for example, the amount of correction made with respect to UTC and related to coordinates (such as latitude and longitude)) is defined.

When the time information acquisition mode or the position information acquisition mode is set, the baseband section 60 performs demodulation to extract a baseband signal from the converted digital signal (intermediate-frequency-band signal) outputted from the ADC 57 in the RF section 50.

Further, when the time information acquisition mode or the position information acquisition mode is set, the baseband section 60 produces a local code having the same pattern as that of each C/A code in a satellite search step, which will be described later, and examines correlation between the C/A code contained in the baseband signal and the local code. The baseband section 60 then adjusts the timing at which the local code is produced in such a way that the degree of the correlation between the C/A code and the local code peaks. When the degree of the correlation is greater than or equal to a threshold, the baseband section 60 determines that the electronic timepiece 100 has been synchronized with the GPS satellite 20 associated with the local code (that is, the GPS satellite 20 has been located). It is noted that the GPS system employs a CDMA (code division multiple access) scheme, in which the GPS satellites 20 use different C/A codes to transmit satellite signals of the same frequency. Identification of the C/A code contained in a received satellite signal allows search for a locatable GPS satellite 20.

To acquire the satellite information on the located GPS satellite 20 in the time information acquisition mode or the position information acquisition mode, the baseband section 60 mixes a local code having the same pattern as that of the C/A code associated with the GPS satellite 20 with the baseband signal. The mixture signal has a demodulated navigation message containing the satellite information on the located GPS satellite 20. The baseband section 60 then detects a TLM word (preamble data) in each sub-frame of the navigation message and acquires the satellite information, such as the orbit information and the GPS time information, contained in the sub-frame (and stores the satellite information, for example, in the SRAM 63). The GPS time information, which is formed of week number data (WN) and Z count data, may be formed only of the Z count data when the week number data has already been acquired. The baseband section 60 then produces, based on the satellite information, time correction information necessary for correction of the internal time information.

In the time information acquisition mode, more specifically, the baseband section 60 performs timing calculation based on the GPS time information to produce the time correction information. The time correction information in the time information acquisition mode may, for example, be the GPS time information itself or information on a time difference between the GPS time information and the internal time information.

On the other hand, in the position information acquisition mode, more specifically, the baseband section 60 performs the positioning calculation based on the GPS time information and the orbit information to acquire position information (still more specifically, the latitude and longitude of the location of the electronic timepiece 100 at the time of satellite signal reception). The baseband section 60 further refers to the time difference information stored in the flash memory 66 and acquires time difference data related to the coordinates (latitude and longitude, for example) of the electronic timepiece 100 that are identified by the position information. The baseband section 60 thus produces satellite time data (GPS time information) and the time difference data as the time correction information. The time correction information in the position information acquisition mode may be the GPS time information and the time difference data themselves as described above or may, for example, be data on a time difference between the internal time information and the GPS time information instead of the GPS time information.

The baseband section 60 may produce the time correction information from the satellite information on one of the GPS satellites 20 or may produce the time correction information from satellite information on a plurality of the GPS satellites 20.

The action of the baseband section 60 is synchronized with the reference clock signal outputted from the temperature compensated crystal oscillator (TCXO) 65. The RTC 64 produces timing at which a satellite signal is processed. The RTC 64 is incremented in response to the reference clock signal outputted from the TCXO 65.

The control display unit 36 includes the controller 70, a drive circuit 74, and a crystal oscillator 73.

The controller 70 includes a storage device 71 and an RTC (real time clock) 72 and performs a variety of types of control. The controller 70 can be formed, for example, of a CPU. The controller 70 sends a control signal to the GPS receiver 26 to control signal reception action of the GPS receiver 26. The controller 70 further controls the action of the regulators 34 and 35 based on a detection result from the voltage detection circuit 37. The controller 70 further controls drive operation of all the indication hands 13 and a liquid crystal panel via the drive circuit 74.

The storage device 71 stores received data. The controller 70 corrects the internal time information based on the received data. The internal time information is information on the time measured by the electronic timepiece 100, counted by the RTC 72, which is always driven, and updated based on a reference clock signal produced by the crystal oscillator 73. Therefore, even when electric power supplied to the GPS receiver 26 is terminated, the internal time information can be updated to keep the indication hands moving.

When the time information acquisition mode is set, the controller 70 controls the action of the GPS receiver 26 to correct the internal time information based on the GPS time information and stores the corrected internal time information in the storage device 71. More specifically, the internal time information is corrected to UTC (coordinated universal time) calculated by adding a UTC offset to the acquired GPS time information. When the position information acquisition mode is set, the controller 70 controls the action of the GPS receiver 26 to correct the internal time information based on the satellite time data (GPS time information) and the time difference data and stores the corrected internal time information in the storage device 71.

C. Details of Antenna Body and Dielectric Auxiliary Member

Figure 8A:
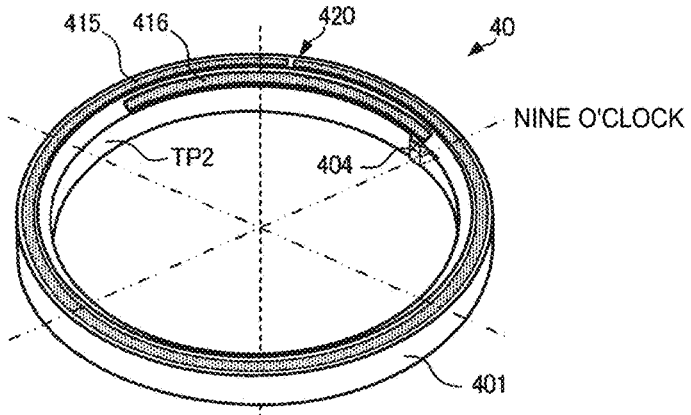
FIG. 8A is a perspective view for describing the shape of the antenna body in the electronic timepiece and antenna patterns formed on the antenna body.

The antenna body 40 will be described in detail with reference to FIGS. 8A and 8B. FIG. 8A is a perspective view of the antenna body 40, and FIG. 8B is a plan view of the antenna body 40.

The antenna body 40 has a ring-shaped base 401, which is made of a resin containing a dielectric material, and a first antenna pattern (antenna element) 415 and a second antenna pattern (antenna element) 416, which are formed on the base 401. The first antenna pattern 415 and the second antenna pattern 416 are made of a metal or any other conductive material. Further, a feed portion 404, which is made of a metal or any other conductive material, is attached to the antenna body 40. The first antenna pattern 415, the second antenna pattern 416, and the feed portion 404 can be formed, for example, in a plating or silver paste printing process. The base 401 is so formed that it has a relative dielectric constant $\in r$ ranging from about 5 to 20, preferably 8 by mixing the resin with a dielectric material that can be used at a high frequency, such as a titanium oxide.

Figure 8B:
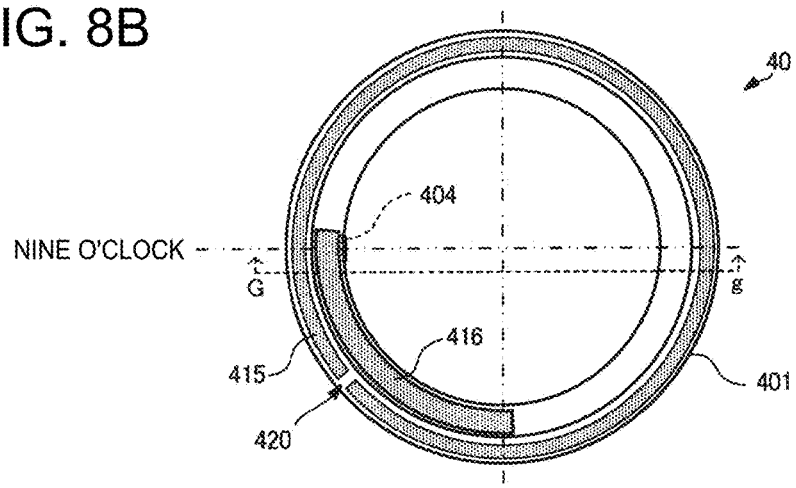
FIG. 8B is a plan view for describing the shape of the antenna body in the electronic timepiece and the antenna patterns formed on the antenna body.

The first antenna pattern 415 has a cutout 420 and therefore has a C-like shape with part of the ring cut off, as shown in FIG. 8B. The first antenna pattern 415 has an antenna length that allows the first antenna pattern 415 to resonate with electrical radiation (satellite signal) from a position information satellite.

The second antenna pattern 416 is an arcuate element in a plan view and so formed that the second antenna pattern 416 is set apart from the first antenna pattern 415 by a fixed distance, as shown in FIG. 8B. The two antenna patterns, the first antenna pattern 415 and the second antenna pattern 416, are electromagnetically coupled to each other and function as an antenna element that converts an electromagnetic wave into a current. The second antenna pattern 416 is a portion that is made of a conductive material and that the feed portion 404 feeds and also called an excitation element. Appropriately setting the length of the second antenna pattern 416 allows the impedance of a circuit electrically connected to the antenna body 40 to be matched with the impedance of the antenna body 40.

The electrical radiation from the GPS satellites 20 has a frequency of about 1.575 GHz and therefore has a wavelength of about 19 cm. To receive a circularly polarized wave, an antenna length of about 1.0 to 1.2 times the wavelength is required. A loop antenna having a length ranging from about 19 to 24 cm is therefore required to receive electrical radiation from the GPS satellites 20. A wristwatch that accommodates a loop antenna having the antenna length described above undesirably has a large size.

In contrast, in the present embodiment, the antenna body 40 has the base 401 made of a material having the relative dielectric constant $\in r$ ranging from about 5 to 20. When the base 401 having the relative dielectric constant $\in r$ is used, the wavelength shortening factor achieved by the base 401 is $(\in r)^{-1/2}$. That is, using a dielectric having the relative dielectric constant Er can shorten the wavelength of electrical radiation received by the antenna body by a factor of $(\in r)^{-1/2}$. That is, the antenna body 40 according to the present embodiment, which has the base 401 having the relative dielectric constant $\in r$, has an antenna length shortened by a factor of $(\in r)^{-1/2}$, whereby the size of the antenna can be reduced, as compared with a case where the base 401 is not provided.

The element length of the second antenna pattern 416 is about 0.25 times the wavelength, and the distance between the second antenna pattern 416 and the first antenna pattern 415 is about 0.01 times the wavelength. The antenna element configuration described above allows efficient reception of a circularly polarized wave based on the combination of radiation from the second antenna pattern 416 and radiation from the first antenna pattern 415. The present embodiment has been described with reference to the case where the first antenna pattern 415 and the second antenna pattern 416 are formed on the upper surface of the base 401, but the antenna patterns only need to be in contact with the base 401 and may be formed, for example, on the outer side surface of the base 401. Forming the antenna patterns on the outer side surface of the base 401 is more preferable than forming them on the upper surface of the base 401 because the antenna patterns can be longer.

The dielectric auxiliary member 41 in the present embodiment will next be described in detail with reference to FIGS. 4 to 6. In general, when an antenna body is accommodated in a metal case, electrical radiation carrying a satellite signal from any of the GPS satellites 20 is blocked by the metal case, and the reception sensitivity of the antenna body therefore lowers. In the present embodiment, since the bezel 82, which is part of the case 80 and located in the vicinity of the antenna body 40, is made of a metal, the antenna body 40 and the bezel 82 are preferably set apart from each other to prevent the reception sensitivity of the antenna body from lowering. However, setting the diameter of the cover glass plate 84 at a large value to separate the antenna body 40 and the bezel 82 from each other undesirably increase the size of the timepiece.

To separate the antenna body 40 and the bezel 82 from each other without greatly increasing the size of the cover glass plate 84, it is conceivable to reduce the size of the antenna body 40. In the present embodiment, the size of the antenna body 40 is reduced by disposing the dielectric auxiliary member 41 along the antenna body 40 to achieve a wavelength shortening effect, as described above.

To enhance the wavelength shortening effect achieved by a dielectric, it is also conceivable to form the base 401 of the antenna body 40, for example, by using a ceramic material having a large dielectric constant. In the present embodiment, however, it is necessary to provide a fixing member that fixes the dial 11 to the main plate 38 and a fixing member that fixes the solar panel 87 to the main plate 38, and the base 401 of the antenna body 40, which is disposed above the fixing members, needs to have recesses 430, which prevent interference between the base 401 and the fixing members, as shown in FIG. 5. Further, a hook member for fixing purposes is used to fix the antenna body 40 itself to the main plate 38, and a fixing portion 431, which the hook member is fit into and fixed to, also needs to be formed in the base 401 of the antenna body 40, as shown in FIG. 5.

As described above, since the base 401 of the antenna body 40 needs to have a complicated shape, the base 401 cannot be made of a ceramic material or any other material that has a large dielectric constant but is too hard to be processed. In view of the situations described above, in the present embodiment, the dielectric auxiliary member 41 having a dielectric constant greater than the dielectric constant of the antenna body 40 is disposed between the antenna body 40 configured as described above and the bezel 82 to enhance the wavelength shortening effect achieved by a dielectric. The dielectric auxiliary member 41 does not need to be processed into a complicated shape but may be processed into a relatively simple shape. A ceramic material or any other material having hardness higher than the hardness of the base 401 can therefore be employed. To ensure satisfactory antenna performance, the antenna patterns need to be set apart from the metal bezel 82 by at least about 1 mm, resulting in a space between the antenna body and the metal bezel 82. In the present embodiment, the dielectric auxiliary member 41 is disposed in the space, which means that the space can be effectively used, whereby the antenna performance can be ensured with the size of the timepiece kept compact.

In the present embodiment, the dielectric auxiliary member 41 is made of zirconia ($ZrO_2$), which is a ceramic material, and formed in an annular shape, as shown in FIG. 6. Further, the dielectric auxiliary member 41 is so formed that it has a rectangular cross-sectional shape, as shown in FIG. 4. The thickness of the dielectric auxiliary member 41 in the radial direction is desirably at least 1 mm to achieve a wavelength shortening effect. The dielectric constant of zirconia ($ZrO_2$) ranges from 30 to 40, which is greatly higher than the dielectric constant of the base 401 of the antenna body 40. In the present embodiment, the distance from the outer circumference of the antenna body 40 to the inner surface of the bezel 82 is set at a value ranging from about 1 to 6 mm by way of example. Further, the distance between the antenna body 40 and the dielectric auxiliary member 41 is desirably at least 0.05 mm. The reason for this is that tolerance of about 0.05 mm in ceramic processing may cause the antenna body 40 and the dielectric auxiliary member 41 to come into contact with each other unless the distance therebetween is at least 0.05 mm. Since a ceramic material has a large dielectric constant, a slight change in the distance between the antenna body 40 and the dielectric auxiliary member 41 causes the resonance frequency of the antenna body 40 to change. To stabilize the resonance frequency of the antenna, it is therefore preferable that the antenna body 40 and the dielectric auxiliary member 41 are set apart from each other as compared with a configuration in which the outer circumference of the antenna body 40 is in contact with the dielectric auxiliary member 41. On the other hand, the dial ring 83 made of ABS or any other resin, which covers the antenna body 40 and the dielectric auxiliary member 41, do not prevent them from receiving GPS electrical radiation. The dielectric auxiliary member 41 is not necessarily made of a ceramic material and may instead be made of a resin material having a dielectric constant greater than that of the base 401 of the antenna body 40. In this case, cost reduction is achieved as compared with the case where the dielectric auxiliary member 41 is made of a ceramic material. It is, however, noted that when a large amount of dielectric material is mixed with the resin, which is a base material, the hardness of the mixture increases and formability thereof decreases accordingly. In this case, it is difficult to form the dielectric auxiliary member 41 in a complicated shape.

According to the present embodiment described above, using the dielectric auxiliary member 41 combined with the antenna body 40 allows the size of the antenna body 40 to be reduced and excellent antenna characteristics to be provided even when the bezel 82 is made of a metal. Further, since the bezel 82 can be made of a metal, design flexibility can be increased. Unlike a case where the bezel 82 is made of a ceramic material, which increases the cost of a polishing process for surface finishing, the processing cost can be reduced because the bezel 82 is made of a metal. Moreover, since the dielectric auxiliary member 41 made of a ceramic material is hidden in the case 80, no surface finishing is required but a simple annular shape can be employed, whereby the processing cost can be relatively low.

Second Embodiment

A second embodiment of the invention will next be described with reference to FIG. 9. The first embodiment has been described with reference to the case where the dielectric auxiliary member 41 has a rectangular cross-sectional shape. The present embodiment will be described with reference to a case where the dielectric auxiliary member 41 has an L-like cross-sectional shape. The same components as those in the first embodiment will not be described.

Figure 9:
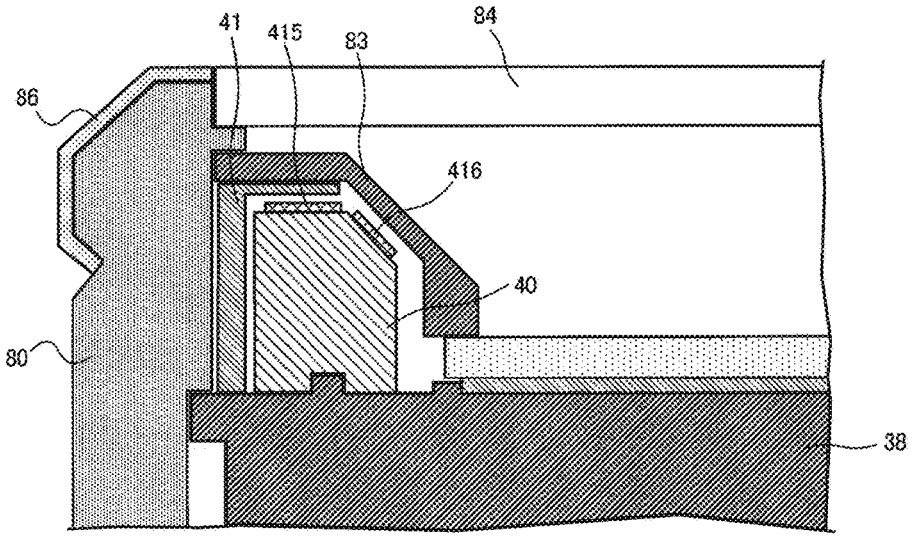
FIG. 9 is a partial cross-sectional view of an antenna body and components therearound in an electronic timepiece according to a second embodiment.

The dielectric auxiliary member 41 in the present embodiment is made of a ceramic material, such as zirconia ($ZrO_2$), and has an L-like cross-sectional shape, as shown in FIG. 9. Specifically, part of the dielectric auxiliary member 41 is disposed between the antenna body and the case, and the other part is disposed between the antenna body and the cover glass plate. That is, the dielectric auxiliary member 41 also covers the upper surface of the antenna body 40 in FIG. 9. The first antenna pattern 415 is formed on the upper surface of the antenna body 40 in FIG. 9 as in the first embodiment, and part of the dielectric auxiliary member 41 is located immediately above the first antenna pattern 415 and covers it. As a result, the dielectric auxiliary member 41 is disposed in a position closer to the first antenna pattern 415 than in the first embodiment, whereby a greater wavelength shortening effect can be achieved, and the size of the antenna body 40 can be smaller than in the first embodiment. The first antenna pattern 415, which is a passive element, is not necessarily provided on the antenna body 40 and may instead be provided on the dielectric auxiliary member 41. In this case, since the antenna pattern is located in a higher position with respect to a metal cover 86 than in the first embodiment, the blocking effect of the metal on a GPS signal can be reduced and the antenna performance is therefore improved. Further, a recess is present in the bottom of the antenna body 40, and a protrusion on the main plate 38 in the movement fits into the recess, whereby the antenna body 40 can be readily positioned. The antenna body, which is formed in a resin molding process, has high shape flexibility.

Further, in the present embodiment, the case 80 is made of a resin, and the case barrel and the bezel are integrated with each other. Part of the surface of the bezel portion is covered with the metal plate cover 86. That is, in a side view of the electronic timepiece, the portion that covers at least part (antenna element) of the antenna body 40 has a portion made of a metal. When the case 80 is made of a resin but part of the surface of the case 80 is covered with the metal plate cover 86 as described above, electrical radiation carrying a satellite signal from any of the GPS satellites 20 is blocked by the metal plate cover 86. In the present embodiment, however, in which the dielectric auxiliary member 41 having a dielectric constant greater than the dielectric constant of the antenna body 40 is disposed between the case 80 and the antenna body 40, a large wavelength shortening effect is achieved, whereby the size of the antenna body 40 can be reduced. As a result, the metal plate cover 86 and the antenna body 40 can be appropriately set apart from each other, whereby the reception sensitivity of the antenna body 40 will not lower.

In the present embodiment, a recess is provided in a lower portion of the antenna body 40, and a protrusion on the main plate 38 fits into the recess, whereby the antenna body 40 can be positioned. The antenna body, which is formed in a molding process, has high shape flexibility.

The L-like cross-sectional shape may be achieved by the unitary dielectric auxiliary member 41 described above or may be achieved by using two members, a ceramic member that covers the outer side surface of the antenna body 40 and a ceramic member that covers the upper surface of the antenna body 40. The latter configuration allows reduction in the processing cost.

Third Embodiment

Figure 10:
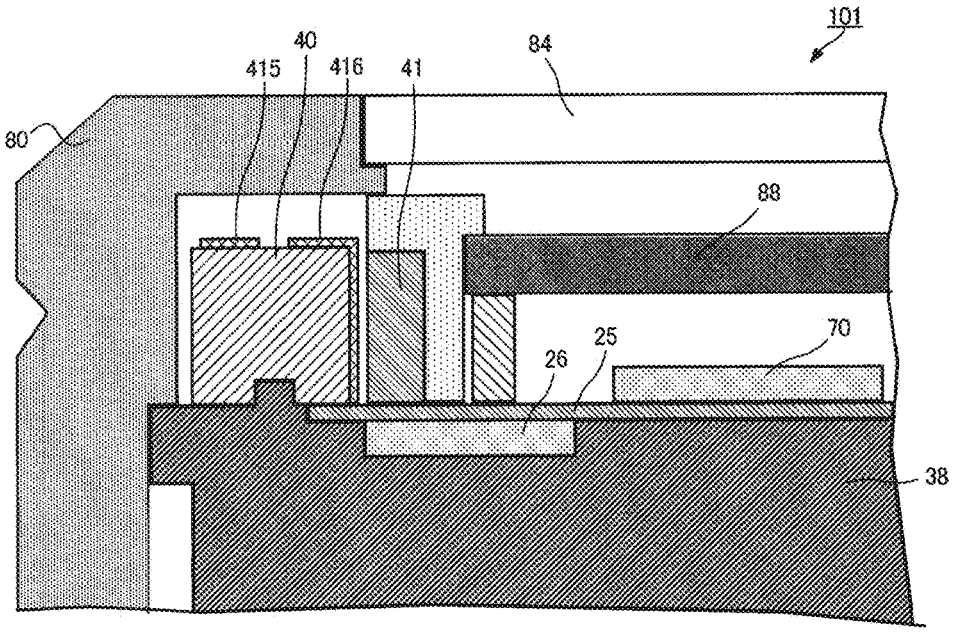
FIG. 10 is a partial cross-sectional view of an antenna body and components therearound in an electronic timepiece according to a third embodiment.

A third embodiment of the invention will next be described with reference to FIG. 10. FIG. 10 is a cross-sectional view showing the antenna body 40 and components therearound in a digital timepiece 101 according to the present embodiment. The above embodiments have been described with reference to the case where the invention is applied to an electronic timepiece with a dial and indication hands. On the other hand, the present embodiment relates to a case where the invention is applied to a digital timepiece using a liquid crystal panel as the time display section.

The case 80 shown in FIG. 10 is made of a resin, and a liquid crystal panel 88 is disposed below the cover glass plate 84. In the present embodiment, the first antenna pattern 415 and the second antenna pattern 416 are formed on the upper surface of the antenna body 40 as in the embodiments described above, and an antenna connection pattern (not shown) is directly connected to the circuit substrate 25 via no feed pin. In the present embodiment, in which the case 80 is made of a resin but no metal cover is attached to the exterior of the case 80, the case 80 and the antenna body 40 are not required to be set apart from each other, and the diameter of the antenna body 40 can therefore be increased, whereby the performance of the antenna body 40 can be improved.

On the other hand, in the present embodiment, the antenna body 40 is subject to noise from the liquid crystal panel 88. To lower an effect of the noise from the liquid crystal panel 88 on the antenna body 40, the antenna body 40 is preferably set apart from the liquid crystal panel 88. Too long a distance between the antenna body 40 and the liquid crystal panel 88, however, makes the size of the overall digital timepiece 101 too large. To address the problem, in the present embodiment, the annular dielectric auxiliary member 41 is disposed between the liquid crystal panel 88 and the antenna body 40. The dielectric auxiliary member 41 is positioned and fixed between the liquid crystal panel 88 and the antenna body 40 with the aid of a resin spacer. The dielectric auxiliary member 41 disposed inside the antenna body 40 allows a wavelength shortening effect to be achieved, whereby the size of the antenna body 40 can be reduced. As a result, the liquid crystal panel 88 and the antenna body 40 can be set apart from each other by an appropriate distance, whereby the effect of the noise from the liquid crystal panel 88 on the antenna body 40 can be reduced.

Fourth Embodiment

Figure 11:
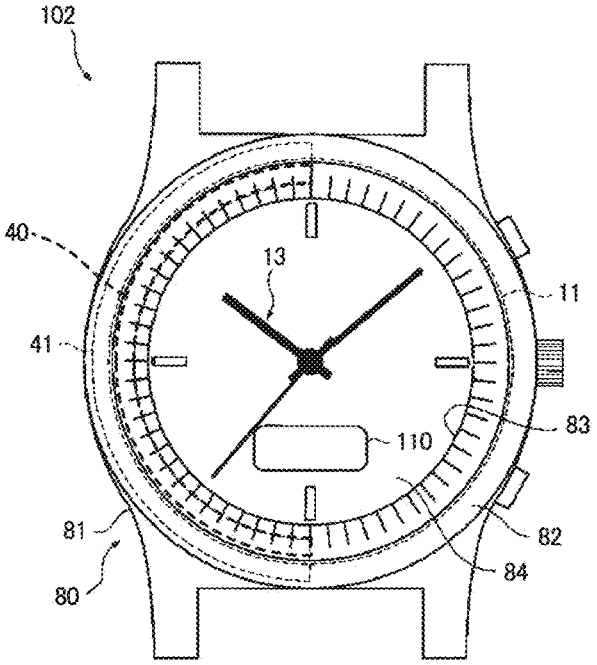
FIG. 11 is a plan view of an electronic timepiece according to a fourth embodiment.
Figure 12:
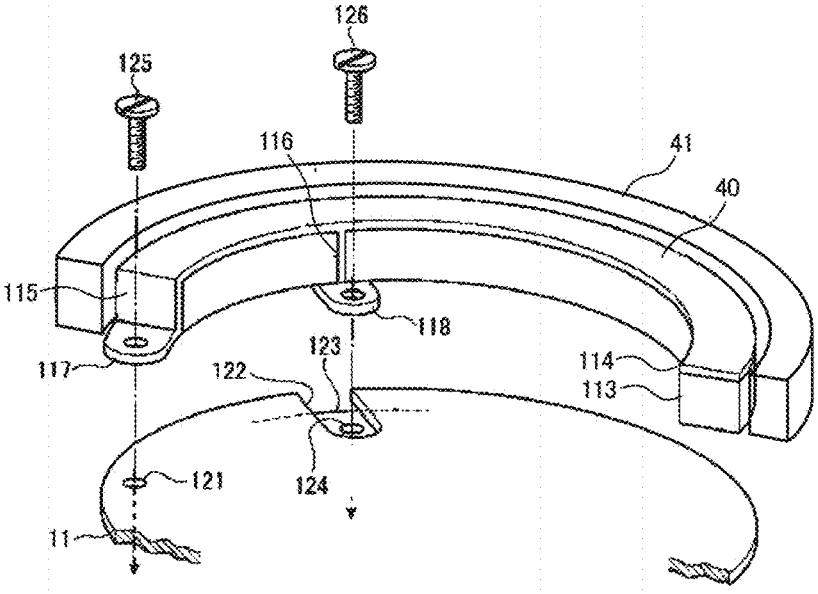
FIG. 12 is a perspective view showing an antenna in the electronic timepiece according to the fourth embodiment.

A fourth embodiment of the invention will next be described with reference to FIGS. 11 and 12. FIG. 11 is a plan view of an electronic timepiece 102 according to the present embodiment, and FIG. 12 is a perspective view showing the antenna body 40 in the present embodiment. The above embodiments have been described with reference to the case where the antenna body 40 continuously extends in an annular shape, and the present embodiment relates to a case where the antenna body 40 does not continuously extend in an annular shape.

The electronic timepiece 102 according to the present embodiment includes an antenna body 40 having a substantially C-like shape in a plan view that extends in an arcuate shape along and inside the outer circumference of the dial 11, as shown in FIG. 11. Further, a dielectric auxiliary member 41 having a substantially C-like shape in a plan view is provided between the bezel 82 and the antenna body 40.

The antenna body 40 includes an arcuate base 113 made of a dielectric and having a rectangular cross-sectional shape, and an antenna electrode (antenna element) 114 is formed on the front surface of the base 113, as shown in FIG. 12. The base 113 can be made of a synthetic resin material.

The antenna electrode 114 is formed by bending a conductive metal plate, such as a copper plate, and attaching the metal plate to the front surface of the base 113. The antenna electrode 114 may instead be formed by patterning the front surface of the base 113. One end of the antenna electrode 114 is routed via an end surface of the base 113 toward the rear side and extends to the bottom surface of the base 113 (surface in contact with dial 11), and the one end portion forms a grounded portion 115. At a middle portion of the antenna electrode 114, a branch that extends via a side surface of the base 113 to the bottom surface thereof is formed, and the branch forms a feeding portion 116. The grounded portion 115 and the feeding portion 116 are made of the same material as that of the antenna electrode 114.

A ground-side fixing portion 117 is formed at the front end of the grounded portion 115, and a feed-side fixing portion 118 having a screw hole is connected to the front end of the feeding portion 116. The ground-side fixing portion 117 is formed by further extending the grounded portion 115 and then bending it in a direction away from the base 113. The ground-side fixing portion 117 has an insertion hole that passes through the front and rear sides of the ground-side fixing portion 117 and is used for fixing purposes, and the ground-side fixing portion 117 is formed to be flush with the bottom surface of the base 113. The feed-side fixing portion 118 is formed of a metal piece connected to the lower end of the feeding portion 116, has an insertion hole that passes through the front and rear sides of the feed-side fixing portion 118 and is used for fixing purposes, and is disposed along the bottom surface of the base 113.

In the dial 11 are formed a threaded hole 121 in a position corresponding to the insertion hole in the ground-side fixing portion 117 and a cutout 122 having a contour corresponding to the feed-side fixing portion 118. A feed terminal 123 is exposed through the cutout 122. The feed terminal 123 is disposed on the rear side of the dial 11 and electrically connected to a signal terminal on the circuit substrate 25, and a threaded hole 124 is formed in the feed terminal 123 in a position corresponding to the insertion hole in the feed-side fixing portion 118.

The antenna body 40 is fixed to the dial 11 with screws 125 and 126. The screw 125 is inserted through the insertion hole in the ground-side fixing portion 117 and screwed into the threaded hole 121 in the dial 11. The screw 126 is inserted through the insertion hole in the feed-side fixing portion 118 and screwed into the threaded hole 124 in the feed terminal 123. After the antenna body 40 is fixed to the dial 11, the feed-side fixing portion 118 is accommodated in the cutout 122 of the dial 11, and the bottom surfaces of the ground-side fixing portion 117 and the base 113 come into intimate contact with the front surface of the dial 11.

In the state in which the antenna body 40 is fixed, the ground-side fixing portion 117 is electrically conductive with the dial 11, and the feed-side fixing portion 118 is electrically conductive with the feed terminal 123. It is, however, noted that the feed-side fixing portion 118 and the dial 11 are maintained insulated from each other. The grounded portion 115 of the antenna body 40 is thus connected via the dial 11 to a ground terminal on the circuit substrate 25. Further, the feeding portion 116 of the antenna body 40 is connected via the feed terminal 123 to the signal terminal on the circuit substrate 25. To maintain the state in which the feed-side fixing portion 118 and the dial 11 are insulated from each other, the cutout 122 is formed to be greater than the outer circumferential shape of the feed-side fixing portion 118 to maintain a gap between the cutout 122 and the feed-side fixing portion 118, and a gap between the feed terminal 123 and the rear surface of the dial 11 is appropriately maintained or an insulating material is sandwiched therebetween, or any other measure should be taken.

In the present embodiment, in which the antenna body 40 has a substantially C-like shape in a plan view as described above, the dielectric auxiliary member 41 disposed between the bezel 82 and the antenna body 40 also has a substantially C-like shape in a plan view as shown in FIGS. 11 and 12. In the present embodiment, the dielectric auxiliary member 41 made of a ceramic material having a large dielectric constant achieves a wavelength shortening effect, whereby the size of the antenna body 40 can be reduced, as in the embodiments described above. As a result, even when the bezel 82 is made of a metal or the case made, for example, of a resin is covered with the metal cover 86, the bezel 82 or the cover 86 and the antenna body 40 can be appropriately set apart from each other, whereby excellent antenna characteristics are achieved.

Variations

The invention is not limited to the embodiments described above, and a variety of variations are conceivable, for example, as will be described below. Arbitrarily selected one or more of the variations that will be described below can also be combined with each other as appropriate.

Variation 1

The above first embodiment has been described with reference to the case where the antenna pattern (antenna element) on the antenna body 40 is formed of the first antenna pattern 415, which serves as a passive element, and the second antenna pattern 416, which serves as an excitation element. The invention is not limited to the case described above, and no passive element is used and a C-shaped loop element is directly fed and used as an excitation element, or an O-shaped loop element having a seamless loop shape may be used to receive a circularly polarized wave.

Variation 2

The above first embodiment has been described with reference to the case where the invention is applied to an electronic timepiece with an antenna body that receives electrical radiation from a GPS satellite. The invention is not limited to the case described above and is also applicable to a timepiece including an antenna body and a communication section that supports, for example, Bluetooth (registered trademark), Wi-Fi (registered trademark), or any other communication standard and provides a function of communicating with another apparatus.

The entire disclosure of Japanese Patent Application No. 2014-017369, filed Jan. 31, 2014, is expressly incorporated by reference herein.

What is claimed is:

1. An electronic timepiece comprising:
a case that includes a cylindrical case barrel and a bezel;
a time display section;
an antenna body that is disposed around an outer circumferential portion of the time display section but accommodated in the case and includes a base and an antenna element, the base being made of dielectric material; and
a dielectric auxiliary member that contains a dielectric and at least a part of which is disposed between the antenna body and the bezel,
wherein the dielectric auxiliary member has a dielectric constant greater than the dielectric constant of the base, and
wherein the antenna body and the dielectric auxiliary member are separate components.

2. The electronic timepiece according to claim 1,
wherein the dielectric auxiliary member has hardness higher than the hardness of the base.

3. The electronic timepiece according to claim 1,
wherein the case has a portion that is made of a metal and covers at least part of the antenna body in a side view of the electronic timepiece, and
the dielectric auxiliary member is disposed between the antenna body and the portion made of a metal.

4. The electronic timepiece according to claim 1,
wherein the case has a member that is made of a metal and located on a portion of the case that covers at least part of the antenna body in a side view of the electronic timepiece, and
the dielectric auxiliary member is disposed between the antenna body and the member made of a metal.

5. The electronic timepiece according to claim 4,
wherein the member made of a metal and located in a portion of the case that covers at least part of the antenna body is attached to a member made of a resin.

6. The electronic timepiece according to claim 1,
wherein each of the antenna body and the dielectric auxiliary member is formed in a ring shape.

7. The electronic timepiece according to claim 1,
wherein the base has a recess formed therein and the recess prevents the base from interfering with another member.

8. The electronic timepiece according to claim 1,
wherein the base has a fixing portion formed therein and the fixing portion fixes the antenna body to the base.

9. The electronic timepiece according to claim 1, further comprising
a cover member that covers one opening of the case,
wherein the dielectric auxiliary member has an L-like cross-sectional shape with part of the dielectric auxiliary member disposed between the antenna body and the case and part of the dielectric auxiliary member disposed between the antenna body and the cover member.

10. The electronic timepiece according to claim 1,
wherein the dielectric auxiliary member is disposed between the time display section and the antenna body.

11. The electronic timepiece according to claim 1,
wherein the dielectric auxiliary member is made of a ceramic material.

12. The electronic timepiece according to claim 1,
wherein the bezel is fit into the cylindrical barrel.

13. The electronic timepiece according to claim 1,
wherein the cylindrical case barrel and the bezel are integrated with each other.

14. An electronic timepiece comprising:
a case;
a time display section;
an antenna body that is disposed around an outer circumferential portion of the time display section but accommodated in the case and includes a base and an antenna element, the base being made of dielectric material;
a dial ring that covers at least a part of the antenna body;
a dielectric auxiliary member that contains a dielectric and at least a part of which is disposed between the antenna body and the dial ring,
wherein the dielectric auxiliary member has a dielectric constant greater than the dielectric constant of the base, and
wherein the antenna body and the dielectric auxiliary member are separate components.

15. An electronic timepiece comprising:
a case;
a time display section;
an antenna body that is disposed around an outer circumferential portion of the time display section but accommodated in the case and includes a base and an antenna element, the base being made of dielectric material; and
a dielectric auxiliary member that contains a dielectric and at least a part of which is disposed between the antenna body and the time display section,
wherein the dielectric auxiliary member has a dielectric constant greater than the dielectric constant of the base, and
wherein the antenna body and the dielectric auxiliary member are separate components.

* * * * *